US010697054B2

(12) United States Patent
Kim et al.

(10) Patent No.: US 10,697,054 B2
(45) Date of Patent: Jun. 30, 2020

(54) LOW TEMPERATURE CARBURIZING METHOD AND CARBURIZING APPARATUS

(71) Applicant: KOREA INSTITUTE OF INDUSTRIAL TECHNOLOGY, Cheonan-si, Chungcheongnam-do (KR)

(72) Inventors: Jun Ho Kim, Cheonan-si (KR); Kyu Sik Kim, Andong-si (KR); Uoo Chang Jung, Busan (KR); In Wook Park, Hwaesong-si (KR)

(73) Assignee: KOREA INSTITUTE OF INDUSTRIAL TECHNOLOGY, Cheonan-si, Chungcheongnam-Do (KR)

( * ) Notice: Subject to any disclaimer, the term of this patent is extended or adjusted under 35 U.S.C. 154(b) by 170 days.

(21) Appl. No.: 15/772,199

(22) PCT Filed: Oct. 31, 2016

(86) PCT No.: PCT/KR2016/012402
§ 371 (c)(1),
(2) Date: Apr. 30, 2018

(87) PCT Pub. No.: WO2017/074161
PCT Pub. Date: May 4, 2017

(65) Prior Publication Data

US 2018/0320261 A1 Nov. 8, 2018

(30) Foreign Application Priority Data

Oct. 30, 2015 (KR) ..... 10-2015-0151613

(51) Int. Cl.
*C23C 8/22* (2006.01)
*C23C 8/02* (2006.01)
(Continued)

(52) U.S. Cl.
CPC ..... *C23C 8/22* (2013.01); *C23C 8/02* (2013.01); *C23C 8/20* (2013.01); *C23C 8/80* (2013.01); *C23G 1/02* (2013.01); *C23G 1/085* (2013.01)

(58) Field of Classification Search
CPC .... C23C 8/22; C23C 8/80; C23C 8/02; C23C 8/20
See application file for complete search history.

(56) References Cited

U.S. PATENT DOCUMENTS 6,149,860 A 11/2000 Furukawa et al.
2012/0111454 A1* 5/2012 Moyer ..... C23C 8/22 148/207

FOREIGN PATENT DOCUMENTS

JP 2011017040 A 1/2011
JP 2011080110 A 4/2011
(Continued)

OTHER PUBLICATIONS

International Search Report dated Feb. 2, 2017 for PCT/KR2016/012402, citing the above references.

*Primary Examiner* — Jessee R Roe
(74) *Attorney, Agent, or Firm* — Cantor Colburn LLP

(57) ABSTRACT

A low temperature carburizing method according to the present invention comprises: step (a) for pre-processing a metal to be processed; step (b) for inputting the metal to be processed to a reaction chamber and heating the same to a set temperature; step (c) for forming a vacuum atmosphere in the reaction chamber and introducing a reaction gas thereinto at a predetermined pressure to accelerate carburization; step (d) for supplying the reaction gas to the reaction chamber at a pressure equal to or lower than the pressure of
(Continued)

the reaction gas of step (c) to spread carburization; and step (e) for repeating step (c) and step (d) at predetermined time intervals.

10 Claims, 29 Drawing Sheets

(51) Int. Cl.

| | |
|---|---|
| ***C23C 8/80*** | (2006.01) |
| ***C23C 8/20*** | (2006.01) |
| ***C23G 1/02*** | (2006.01) |
| *C23G 1/08* | (2006.01) |

(56) References Cited

FOREIGN PATENT DOCUMENTS

| | | | |
|---|---|---|---|
| KR | 1020060083496 | A | 7/2006 |
| KR | 1020080095996 | A | 10/2008 |
| WO | 2013150639 | A1 | 10/2013 |

* cited by examiner

5mbr - 0.5mbr

3mbr - 0.5mbr

5mbr - 0mbr

3mbr - 0mbr

3mbr -Maintain

3mbr - 0.5mbr Same interval

LOW TEMPERATURE CARBURIZING METHOD AND CARBURIZING APPARATUS

TECHNICAL FIELD

The present invention relates to the low temperature carburizing method and a carburizing apparatus, and more particularly, to the low temperature carburizing method for repeatedly performing a carburization acceleration process and a carburization spread process to form a carburizing layer.

BACKGROUND ART

Generally, austenite stainless steel exhibits relatively good corrosion resistance. However, it is vulnerable to pitting in an aqueous solution containing Cl group, and is vulnerable to wear due to relatively low hardness. Particularly, there is a limit as to apply it in seawater conditions.

Therefore, in order to solve such a problem, various surface modification methods have conventionally been accomplished to achieve nitriding and carburizing.

However, when the nitriding and carburizing processes are accomplished at a high temperature (a salt bath nitriding process, a high temperature carburizing process, etc), nitrides and carbides are precipitated and corrosion resistance is lowered.

Further, when the nitriding and carburizing processes are accomplished at a low temperature condition, there is a problem that it is difficult to form a carburizing and nitriding layer due to a natural oxide film existing on the surface of a metal.

Therefore, a method for solving such problems is required.

DISCLOSURE

Technical Problem

The present invention has been made in view of the above problems, and has an object to provide a method for forming a uniform and high-quality carburizing layer.

In addition, it has another object of the present invention to provide a carburizing method applicable to a metal to be processed having a complicated shape.

The problems of the present invention are not limited to the above-mentioned problems, and other problems not mentioned can be clearly understood by those skilled in the art from the following description.

Technical Solution

In an aspect, there is provided a low temperature carburizing method, including: step (a) for pre-processing a metal to be processed; step (b) for inputting the metal to be processed to a reaction chamber and heating the same to a set temperature; step (c) for forming a vacuum atmosphere in the reaction chamber and introducing a reaction gas thereinto at a predetermined pressure to accelerate carburization; step (d) for supplying the reaction gas to the reaction chamber at a pressure equal to or lower than the pressure of the reaction gas of step (c) to spread carburization; and step (e) for repeating step (c) and step (d) at predetermined time intervals.

The step (a) includes removing or weakening a natural oxide film by performing a pickling process for the metal to be processed.

The step (b) includes: step (b-1) for forming the reaction chamber in a vacuum atmosphere; step (b-2) for heating an inside of the reaction chamber to a target temperature, and weakening an internal stress of the metal to be processed; and step (b-3) for injecting a processing gas into the reaction chamber and processing a surface of the metal to be processed, and weakening a bonding strength between a natural oxide film and the metal to be processed.

The step (b-2) includes changing the target temperature according to a target hardness of the metal to be processed, and the step (b-3) includes changing a composition of the processing gas according to the target temperature of the step (b-2).

In the step (c), the reaction gas is a mixed gas of 20 to 70% hydrogen gas and 30 to 80% acetylene gas.

The step (c) includes supplying the reaction gas to the reaction chamber at a pressure equal to or less than 5 mbar to accelerate carburization, and the step (d) includes supplying the reaction gas to the reaction chamber at a pressure equal to or more than 0.5 mbar and equal to or less than the pressure of the reaction gas of the step (c) and spreading the carburization.

The step (c) includes supplying the reaction gas at a pressure of 3 mbar, and the step (d) includes supplying the reaction gas at a pressure of 0.5 mbar.

The step (c) includes supplying the reaction gas at a pressure of 5 mbar, and the step (d) includes supplying the reaction gas at a pressure of 0.5 mbar.

The step (d) includes stopping an injection of the reaction gas and forming a vacuum atmosphere in the reaction chamber.

The step (e) includes gradually reducing a total process time of the step (c) which is repeated.

The step (e) includes gradually increasing a total process time of the step (d) which is repeated.

In another aspect, there is provided a low temperature carburizing apparatus, including: a surface processing frame which is formed of a transition metal, and forms a plurality of layers in such a manner that at least some areas are spaced apart from each other to form a gas flow space where a metal member to be processed for performing a carburization processing is placed, wherein the surface processing frame includes a plurality of through holes through which a reaction gas flows into the gas flow space to allow the reaction gas to flow along a surface of the metal member to be processed.

The surface processing frame is implemented in a form of mesh and is provided in at least one side of the metal member to be processed which forms a single layer.

The surface processing frame is implemented in a form of steel wool, which is assembled with each other to form a single layer, that is provided in at least one side of the metal member to be processed.

The surface processing frame is implemented in a form in which mesh and steel wool which is assembled with each other are overlapped to form a single layer that is provided in at least one side of the metal member to be processed.

Advantageous Effects

The low temperature carburizing method and the carburizing apparatus of the present invention for solving the above problems have the following effects.

First, a carburizing layer can be effectively formed on a metal to be processed even in a low temperature atmosphere.

Second, as the transition metal reaction gas (carbonized gas) meets the transition metal (Fe, Cr, Ni etc.), the decomposition is promoted due to the autocatalytic reaction, and thus the quantity of the carburized adsorbed atom (Adatom) which is decomposed and generated becomes increased to enhance the carburizing ability and the homogenization, and the occurrence of carbon aggregation (sooting) is reduced.

Third, since the occurrence of carbon aggregates in the outer surface of the metal member to be processed which performed the carburization processing is suppressed, the post-processing process can be omitted.

Fourth, the mechanical properties of a metal member to be processed can be improved due to the carburizing layer of excellent quality.

Fifth, it can be effectively applied to a subject having a complicated shape such as a ferrule.

The effects of the present invention are not limited to the effects mentioned above, and other effects not mentioned can be clearly understood by those skilled in the art from the description of the claims.

MODE FOR INVENTION

Figure 1:
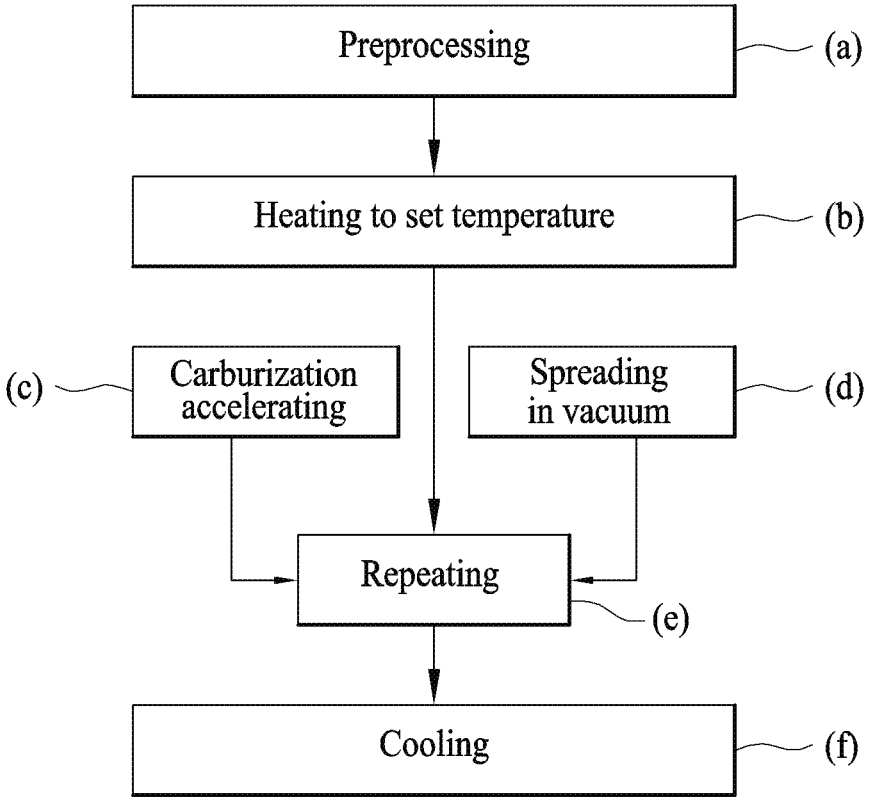
FIG. 1 is a flow chart showing each step of a low temperature carburizing method according to a first embodiment of the present invention.

Hereinafter, preferred embodiments of the present invention is described with reference to the accompanying drawings. In describing the present embodiment, the same designations and the same reference numerals are used for the same components, and further description thereof will be omitted.

FIG. 1 is a flow chart showing each step of a low temperature carburizing method according to a first embodiment of the present invention.

As shown in FIG. 1, the low temperature carburizing method according to the present invention includes step (a) for pre-processing a metal to be processed; step (b) for inputting the metal to be processed to a reaction chamber and heating the same to a set temperature; step (c) for forming a vacuum atmosphere in the reaction chamber and introducing a reaction gas thereinto to accelerate carburization; step (d) for supplying the reaction gas to the reaction chamber at a pressure equal to or lower than the pressure of the reaction gas of step (c) to spread carburization; and step (e) for repeating step (c) and step (d) at predetermined time intervals.

In addition, the present embodiment, after the step (e), may further include step (f) of cooling the metal to be processed.

Hereinafter, each of the above steps is described in detail.

Figure 2:
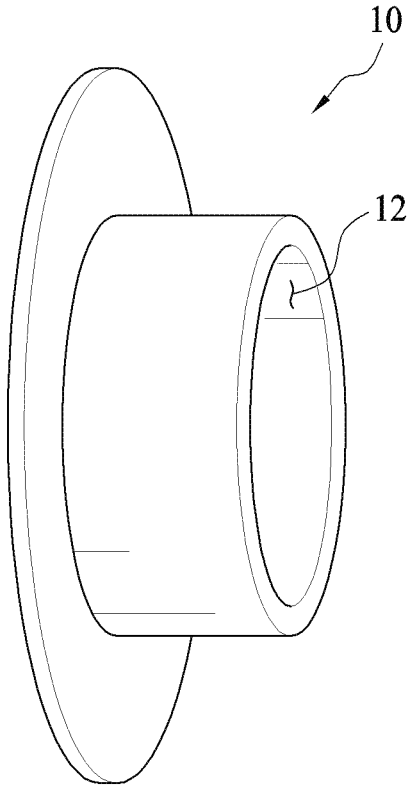
FIG. 2 is a diagram showing a ferrule as a metal to be processed for applying the low temperature carburizing method according to the first embodiment of the present invention.

As shown in FIG. 2, it is assumed that a metal 10 to be processed for applying the low temperature carburizing method according to an embodiment of the present invention is a stainless steel ferrule.

The shape of ferrule 12 may be complicated in comparison with a general object due to a hollow 12, so that there is a disadvantage in that it is difficult to control process parameters, in addition to forming a non-uniform surface layer during the carburizing processing. Therefore, there is a problem that it is difficult to apply a general carburizing method.

In the low temperature carburizing method according to the present embodiment, first, a step of pre-processing a metal to be processed may be performed.

Figure 3:
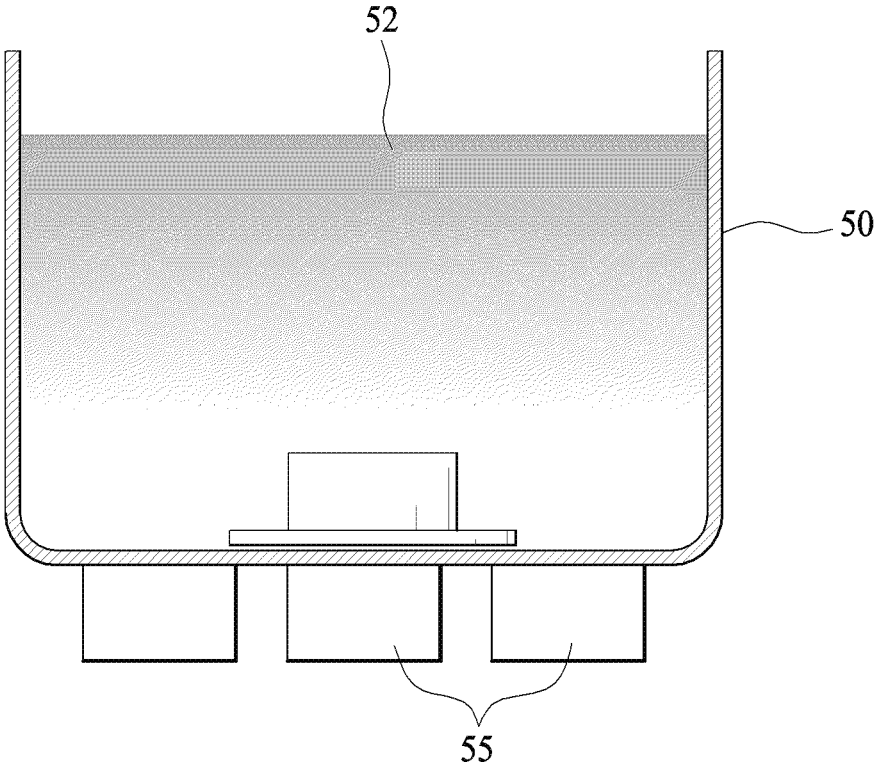
FIG. 3 is a diagram showing a state in which a pre-processing is accomplished for a metal to be processed, in the low temperature carburizing method according to the first embodiment of the present invention.

As shown in FIG. 3, this step may be performed by filling a certain container 50 with an organic solvent 52 and then injecting the metal 10 to be processed into the organic solvent 52 to clean the organic solvent 52.

This is because various lubricants and foreign matter are remained on the surface of the ferrule which is the metal 10 to be processed due to grinding work. Therefore, for an effective carburizing process, washing may be performed using the organic solvent 52.

At this time, acetone, ethanol, and the like may be applied as the organic solvent 52. In the present embodiment, vibration may be applied by using an ultrasonic vibrator 55 provided in a lower part of the container 50, and the metal 10 to be processed may be washed with the acetone or ethanol for about 5 minutes.

In this step, a pickling process may be further performed for the metal to be processed. The pickling step is a step of cleaning after dipping in an acid solution to remove or attenuate a natural oxide film formed on the surface of the metal to be processed. The reason for doing this is to obtain an excellent carburizing effect in a low temperature atmosphere thereafter.

A pickling solution used in the pickling process may be a solution of a first solution containing ammonium hydrogen fluoride ((NH4)(HF2)), nitric acid, and water and a second solution containing hydrogen peroxide and water, in a ratio of 7:3.

In addition, a solution mixed with a weight ratio of 10% sulfuric acid, 4% sodium chloride, and 86% distilled water may be used as the pickling solution.

Alternatively, as the pickling solution, a solution in which 6 to 25% of nitric acid, 0.5 to 8% of hydrogen fluoride (HF), and distilled water of a remaining ratio according to the ratio of nitric acid and hydrogen fluoride are mixed with a volume ratio may be used.

Next, step (b) in which the metal to be processed is charged into a reaction chamber and the temperature is raised to a set temperature may be performed.

Figure 4:
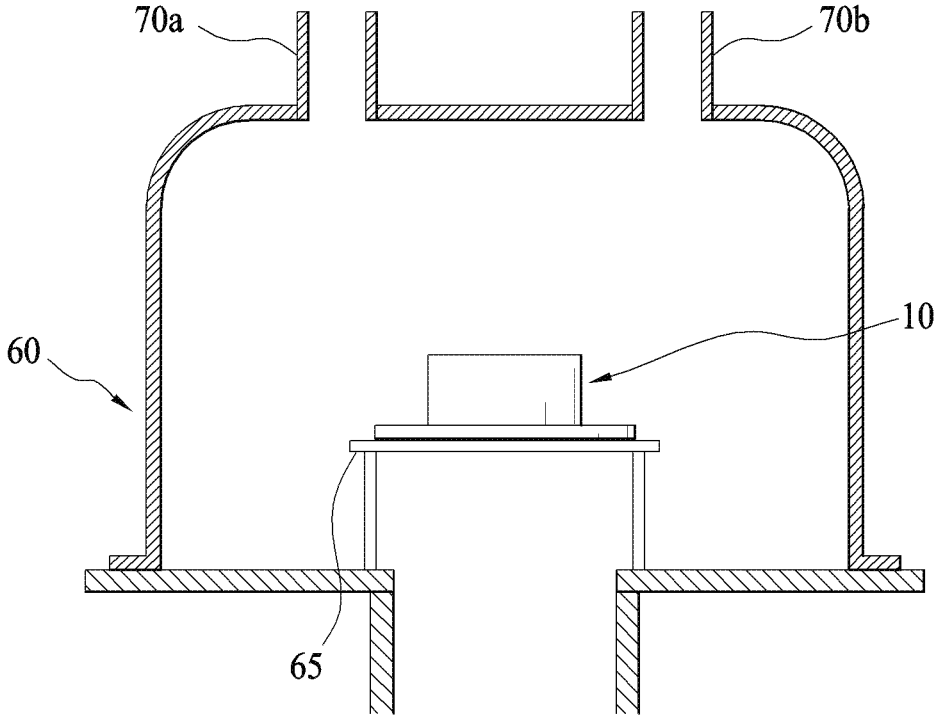
FIG. 4 is a diagram showing a state in which a metal to be processed is charged into a reaction chamber, in the low temperature carburizing method according to the first embodiment of the present invention.

As shown in FIG. 4, in this step, the metal 10 to be processed may be positioned in a reaction chamber 60 to suitably adjust a surface temperature of the metal 10 to be processed.

In the present embodiment, the reaction chamber 60 may include a stage 65 on which the metal 10 to be processed is placed, a first gas inlet 70*a*, and a second gas inlet 70*b*. However, this is just an embodiment and it is obvious that various reaction chambers 60 may be applied.

In addition, in the step (b) of the present embodiment, step (b-1) of forming the reaction chamber 60 in a vacuum atmosphere; step (b-2) of heating the inside of the reaction chamber 60 to a target temperature, and weakening the internal stress of the metal to be processed; and step (b-3) of injecting a process gas into the reaction chamber 60 and processing the surface of the metal 10 to be processed, and weakening the bonding strength between a natural oxide film and the metal to be processed may be performed sequentially.

More specifically, after an initial vacuum atmosphere is formed in the step (b-1), an inert gas may be selectively injected to raise the temperature to a target temperature in the step (b-2). Here, the target temperature may be a temperature suitable for the target hardness of the metal to be processed.

For example, when the target hardness of the metal to be processed is desired to be maintained in the original state of fabricating, the target temperature may be set to a temperature lower than the temperature in the carburization process in steps (c) and (d) to be performed later. In the present embodiment, when the target hardness of the metal to be processed is desired to be maintained in the original state of fabricating, the metal to be processed is processed at 200 to 350° C.

When the target hardness of the metal to be processed is desired to be lowered than the original state of fabricating, the target temperature may be set to be higher than the recrystallization temperature of the material to be performed later. In the present embodiment, since the metal to be processed is a stainless steel ferrule, when the target hardness of the metal to be processed is desired to be lowered than the original state of fabricating, the processing may be performed between 800 and 1100° C. depending on the target hardness.

The reason for doing this is to weaken the internal stress of the metal 10 to be processed. Accordingly, it is obvious that this process can be performed selectively with the pickling process, or both processes can be performed.

Thereafter, in the step (b-3), the process gas may be injected into the reaction chamber 60, and the metal 10 to be processed may be processed for a time suitable for the material hardness of the metal 10 to be processed. At this time, in the present embodiment, the process gas may change the composition of the process gas according to the target temperature of the step (b-2).

For example, in the step (b-2), the process gas may be hydrogen gas, or a mixed gas of hydrogen and hydrocarbons (C2H2, CH4, etc.), or the process gas of an inert atmosphere such as nitrogen may be used. Alternatively, it is also possible to form a vacuum atmosphere without injecting a process gas.

As described above, in the step (b), the above mentioned process may be performed so that the surface temperature of the metal 10 to be processed is increased to weaken the internal stress of the metal 10 to be processed, and weaken the bonding force between the natural oxide film and the metal 10 to be processed, thereby accomplishing the carburizing process more effectively.

Next, step (e) of repeating step (c) of forming the reaction chamber 60 in a vacuum atmosphere and injecting a reaction gas, and step (d) of supplying the reaction gas to the reaction chamber at a pressure equal to or lower than the pressure of the reaction gas of the step (c) and spreading the carburization may be performed. This step may be a step for forming a carburizing layer on the surface of the metal 10 to be processed.

Specifically, in the step (c), the reaction gas may be injected while maintaining a pressure of 2 to 10 mbar in an atmosphere of 400° C. to 500° C. At this time, the reaction gas may be a mixed gas of 20 to 70% of hydrogen gas and 30 to 80% of acetylene gas.

Particularly, in the step (d) of the present embodiment, the reaction chamber 60 may be maintained at a pressure of 0 to 2 mbar to spread a vacuum state. However, the injection of the reaction gas may be stopped completely in the step (d), but the supply of the hydrogen gas in the reaction gas may be maintained.

Alternatively, the supply of the hydrocarbon along with the hydrogen gas may be maintained, or a method of forming a vacuum atmosphere without the reactive gas may be used.

In the step (e), the steps (c) and (d) may be repeatedly performed for about 5 to 30 hours, and then the carburizing layer may be formed on the surface of the metal 10 to be processed.

Figure 5:
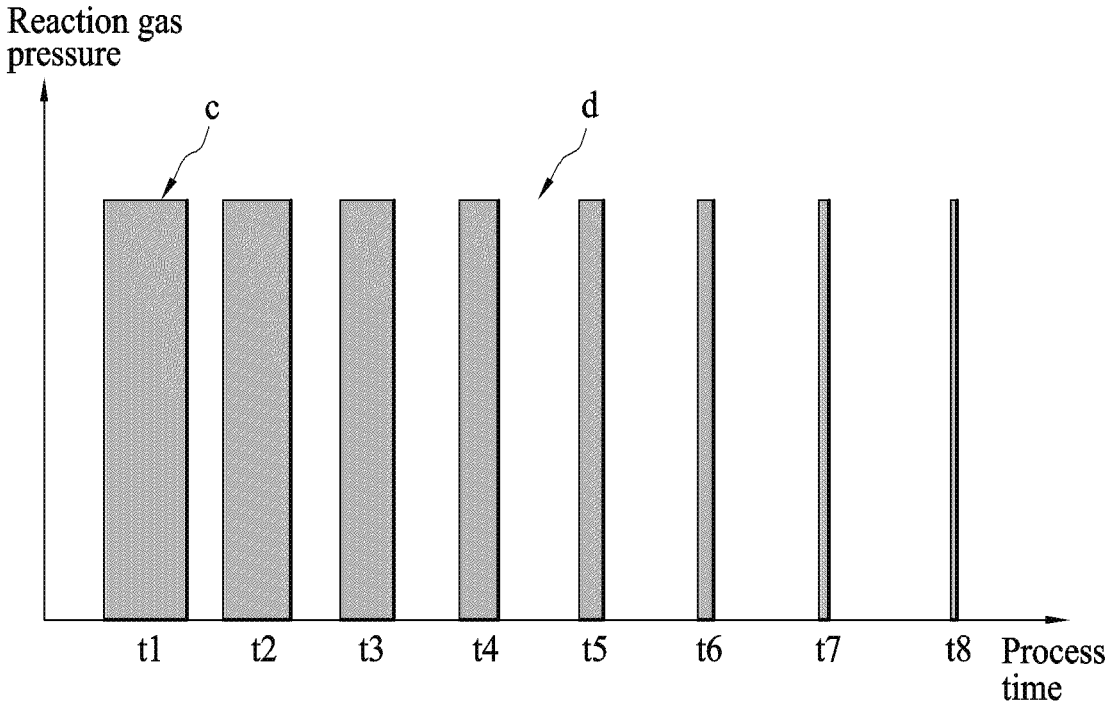
FIG. 5 is a graph showing a process of repeating a carburization acceleration process and the carburization spread process, in the low temperature carburizing method according to the first embodiment of the present invention.

In addition, in the present embodiment, the repeating pattern of step (c) and step (d) may be performed at predetermined time intervals. Referring to FIG. 5, a graph illustrating a process of repeating the carburization acceleration process and a vacuum spread process in a low temperature vacuum carburizing method according to an embodiment of the present invention is shown.

As shown in FIG. 5, the step (e) may gradually reduce the total process time of the step (c), which is repeated, and may gradually increase the total process time of the step (d) which is repeated.

In this case, better carburizing effect may be obtained and the time interval of each step may be set according to the characteristics of the metal 10 to be processed and the process environment.

In the present embodiment, the method of gradually reducing the total process time of the step (c) and the method of gradually increasing the total process time of the step (d) are simultaneously applied. Alternatively, it is obvious that only one method may be performed.

Meanwhile, after this step, step (e) of cooling the metal 10 to be processed may be further performed. In the step (e), the metal 10 to be processed may be cooled naturally, but a separate cooling device or a method of cooling rapidly using a low temperature fluid may be applied.

Hereinafter, experimental results according to the change of condition is described, in each of the above steps.

Figure 6:
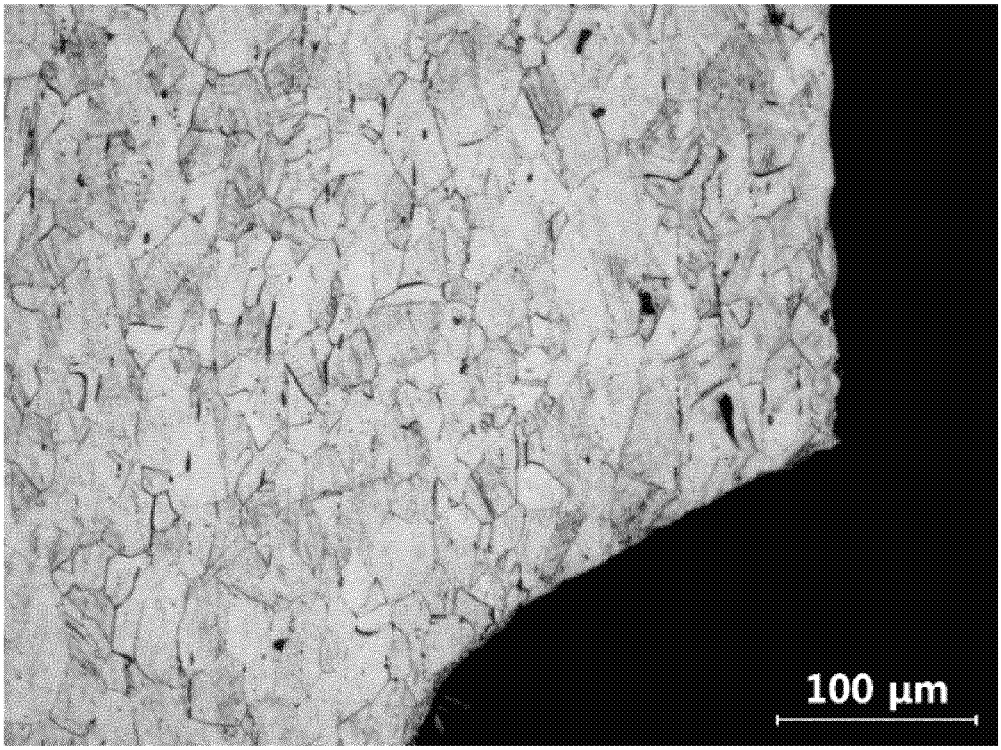
FIG. 6 to FIG. 9 are diagrams showing the result of performing experiments under various conditions.
Figure 7:
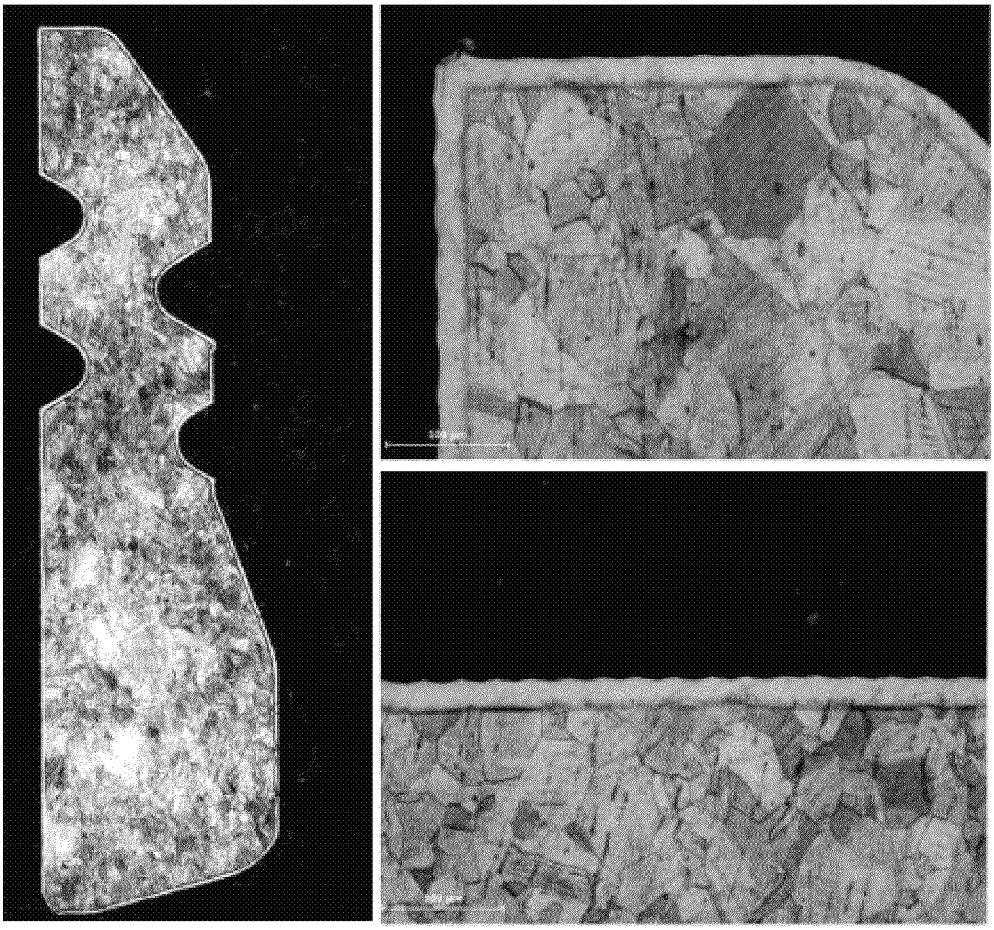
Figure 8:
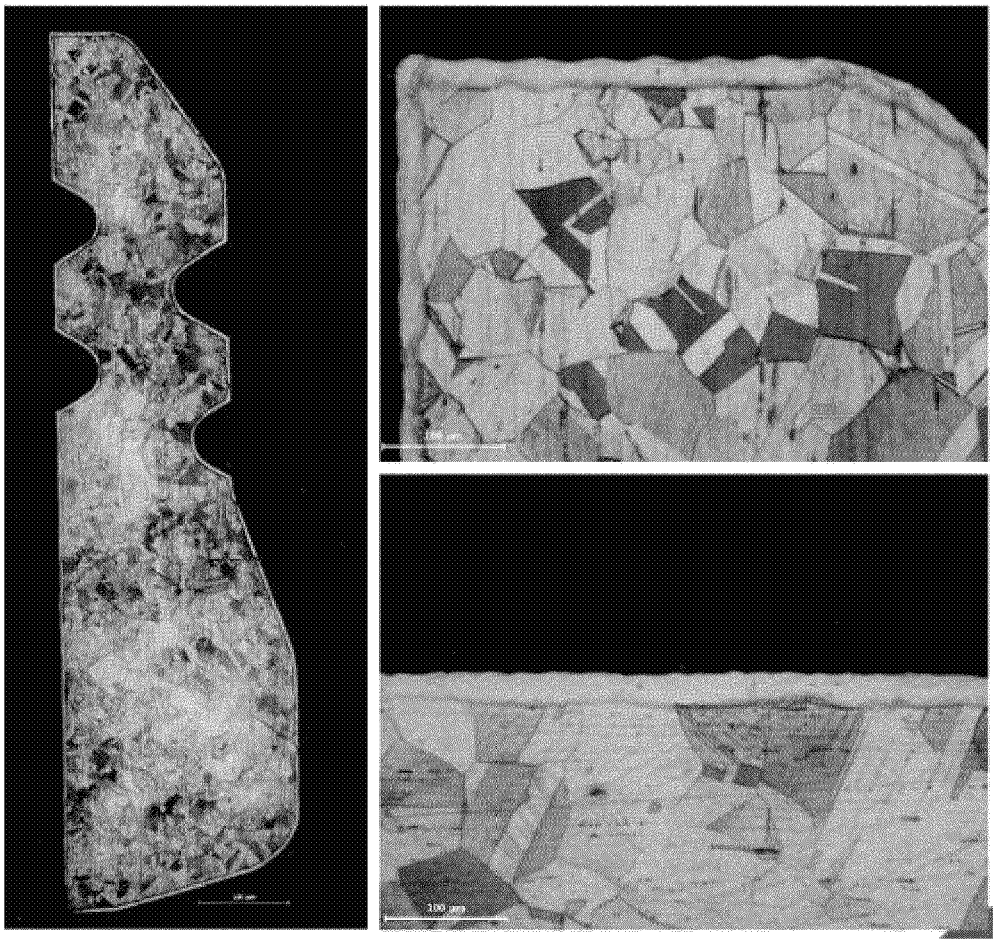

FIG. 6 is a surface shape of a metal to be processed which performed a conventional vacuum carburizing process, and FIG. 7 and FIG. 8 are optical micrographs showing a surface shape of a metal to be processed which performed a vacuum carburizing process according to the present invention.

Particularly, FIG. 7 shows the result of processing the metal to be processed having a material hardness of 340 Hv, and a thickness of the carburizing layer is formed to be 11 to 26 μm as a result of the process that is performed in the step (b-2) for 3 hours at 350° C. to weaken the bonding force between the natural oxide film and the metal to be processed.

In addition, FIG. 8 shows the result of processing the metal to be processed having a material hardness of 250 Hv, and a thickness of the carburizing layer is formed to be 14 to 26 μm as a result of the process that is performed similarly in the step (b-2) for 3 hours at 350° C. to weaken the bonding force between the natural oxide film and the metal to be processed.

As shown in the photographs, in the case of a conventional metal to be processed which performed a conventional vacuum carburization process, the carburizing layer may not be visually checked. However, in the case of a metal to be processed which performed the vacuum carburization process of the present invention shown in FIG. 7 and FIG. 8, it can be recognized that the carburizing layer is clearly formed on the surface.

Figure 9:
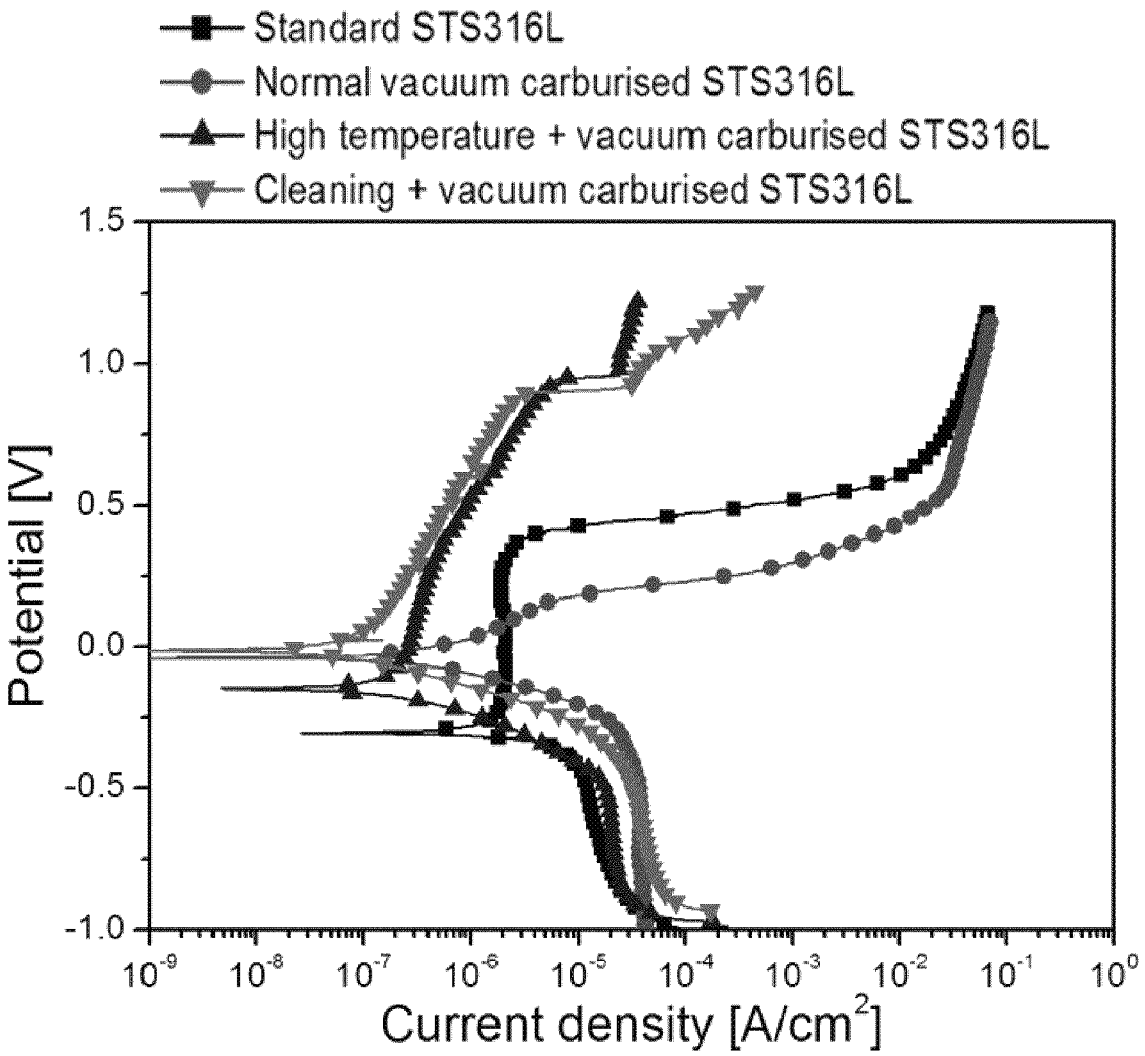

In addition, FIG. 9 illustrate a graph showing a corrosion resistance characteristic of the metal to be processed which processed the carburization according to the above condition.

In the graph shown in FIG. 9, the abscissa indicates the current density and the ordinate indicates the potential energy. It can be interpreted that the corrosion degree is lowered as the potential energy progresses toward a positive value. In the case of current density, it can be interpreted that the corrosion degree is lowered as the value is decreased.

As shown in the graph, it can be recognized that a stainless steel obtained by performing the vacuum carburizing process in a state where the natural oxide film is broken by performing the high-temperature processing in the above mentioned step (b-2), and a stainless steel obtained by performing the vacuum carburizing process in a state where the natural oxide film is broken by performing the pickling process in the above mentioned step (a) exhibit higher potential energy at the same current density, and values are distributed to the left side of the graph as a whole, in comparison with a typical stainless steel (Standard STS316L).

On the other hand, in the case of the metal to be processed which performed a conventional vacuum carburizing process, it can be recognized that lower potential energy may be exhibited at the same current density in some sections, in comparison with a typical stainless steel (Standard STS316L), and values are distributed to the right side of the graph as a whole.

Therefore, it can be recognized that the corrosion resistance characteristic of the metal to be processed which performed the low temperature carburizing method according to the present invention is significantly increased in comparison with the standard corrosion resistance characteristic of a typical stainless steel.

Meanwhile, in the case of the above-described embodiment, the stainless steel ferrule is applied as the metal to be processed, but the metal to be processed is not limited thereto and various types can be used.

Figure 10:
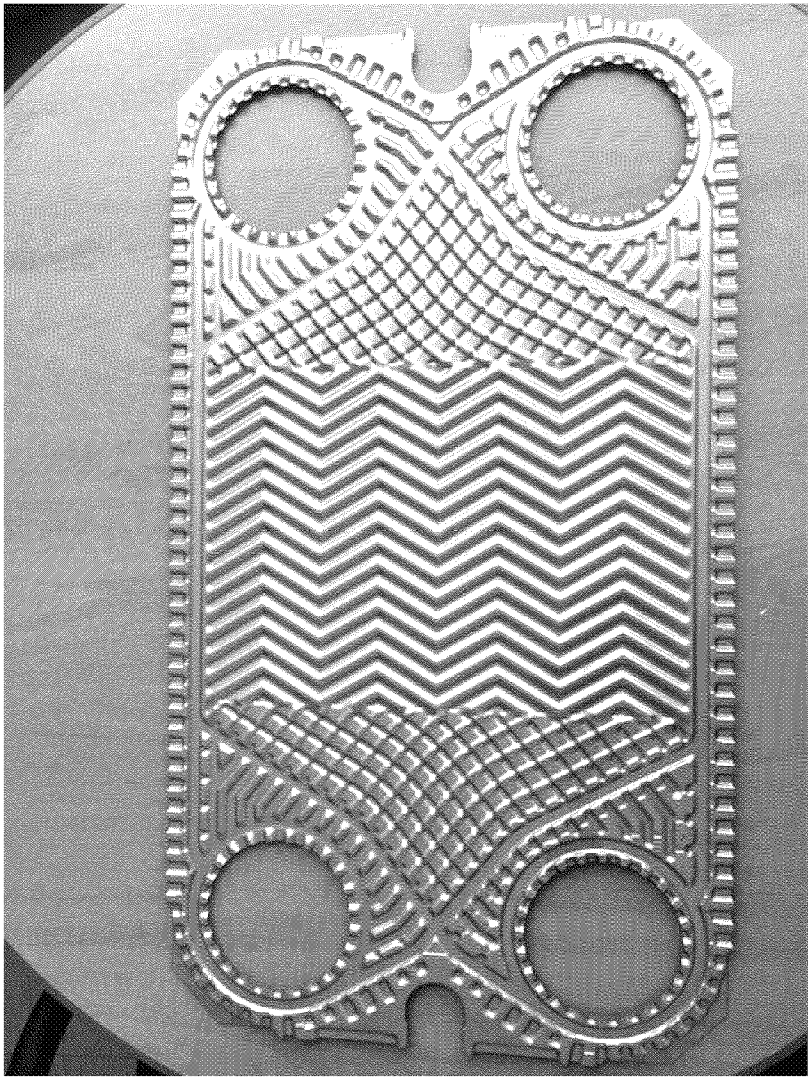
FIG. 10 is a diagram illustrating another object to which the present invention is applicable.

For example, as shown in FIG. 10, a plate-type heat exchanger may be applied as a metal to be processed. The plate-type heat exchanger is required to exhibit excellent abrasion resistance and corrosion resistance at the same time by its nature, and thus suitable as a subject of application of the present invention.

Figure 11:
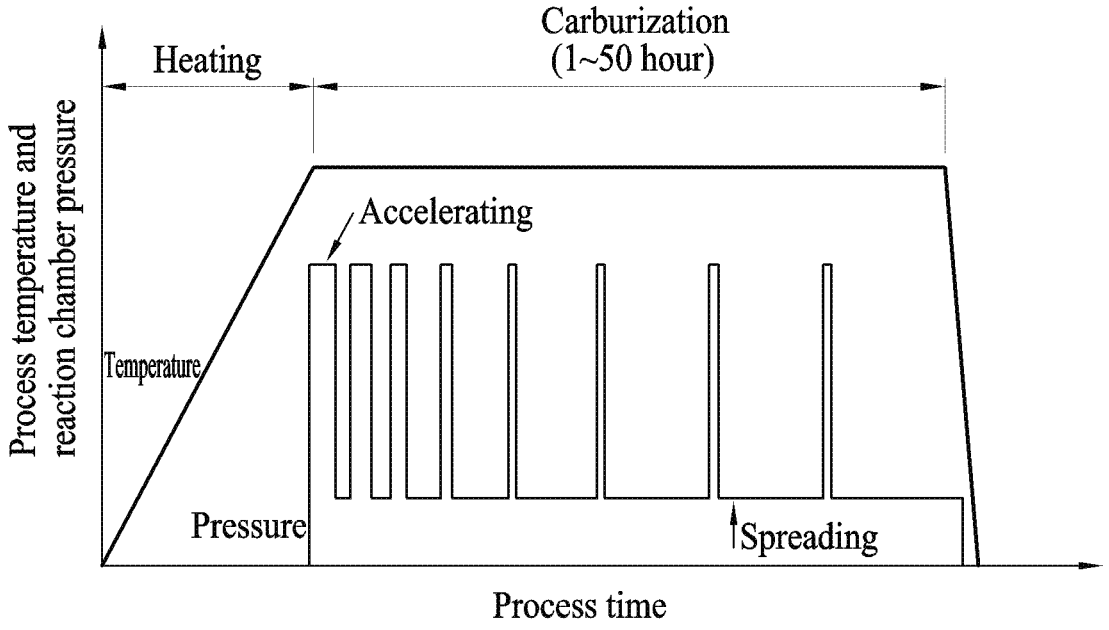
FIG. 11 is a graph showing a process of repeating the carburization acceleration process and the carburization spread process, in a low temperature carburizing method according to a second embodiment of the present invention.

Meanwhile, as a second embodiment of the present invention, as shown in FIG. 11, step (e) of repeating step (c) of supplying the reaction gas to the reaction chamber 60 at a pressure equal to or less than 5 mbar to accelerate carburization and step (d) of supplying the reaction gas to the reaction chamber 60 at a pressure equal to or more than 0.5 mbar and equal to or less than the pressure of the reaction gas of the step (c) and spreading the carburization may be performed.

In the present embodiment, the reaction gas may be supplied at a pressure of 5 mbar or less in an atmosphere of 500° C. or less in the step (c). At this time, the reaction gas may be a mixed gas of 20 to 70% of hydrogen gas and 30 to 80% of acetylene gas.

In the step (d), the reaction gas may be supplied to the reaction chamber 60 at a pressure equal to or more than 0.5 mbar and equal to or less than the pressure of the reaction gas of the step (c).

In the step (e), the above mentioned steps (c) and (d) may be repeatedly performed for about 1 to 50 hours, and then a carburizing layer may be formed on the surface of the metal 10 to be processed.

In the present embodiment, the repeating pattern of the step (c) and step (d) may be performed at predetermined time intervals. Referring to FIG. 5, a graph illustrating a process of repeating the carburization acceleration process and the carburization spread process in the carburizing method within a low pressure range according to an embodiment of the present invention is shown.

As shown in FIG. 11, the step (e) may gradually reduce the total process time of the step (c) which is repeated, and may gradually increase the total process time of the step (d) which is repeated.

In this case, better carburizing effect may be obtained, and the time interval of each step may be set according to the characteristics of the metal 10 to be processed and the process environment.

In the present embodiment, the method of gradually reducing the total process time of the step (c) and the method of gradually increasing the total process time of the step (d)

are simultaneously applied. Alternatively, it is obvious that only one method may be performed.

As described above, according to the present invention, the carburization acceleration and carburization spread processes may be repeated between 0.5 mbar and 5 mbar, so that better carburizing effect can be obtained in comparison with the conventional carburizing methods within a low pressure range of 5 mbar or less.

Hereinafter, experimental results according to the change of condition is described, in each step of the second embodiment.

Figure 12:
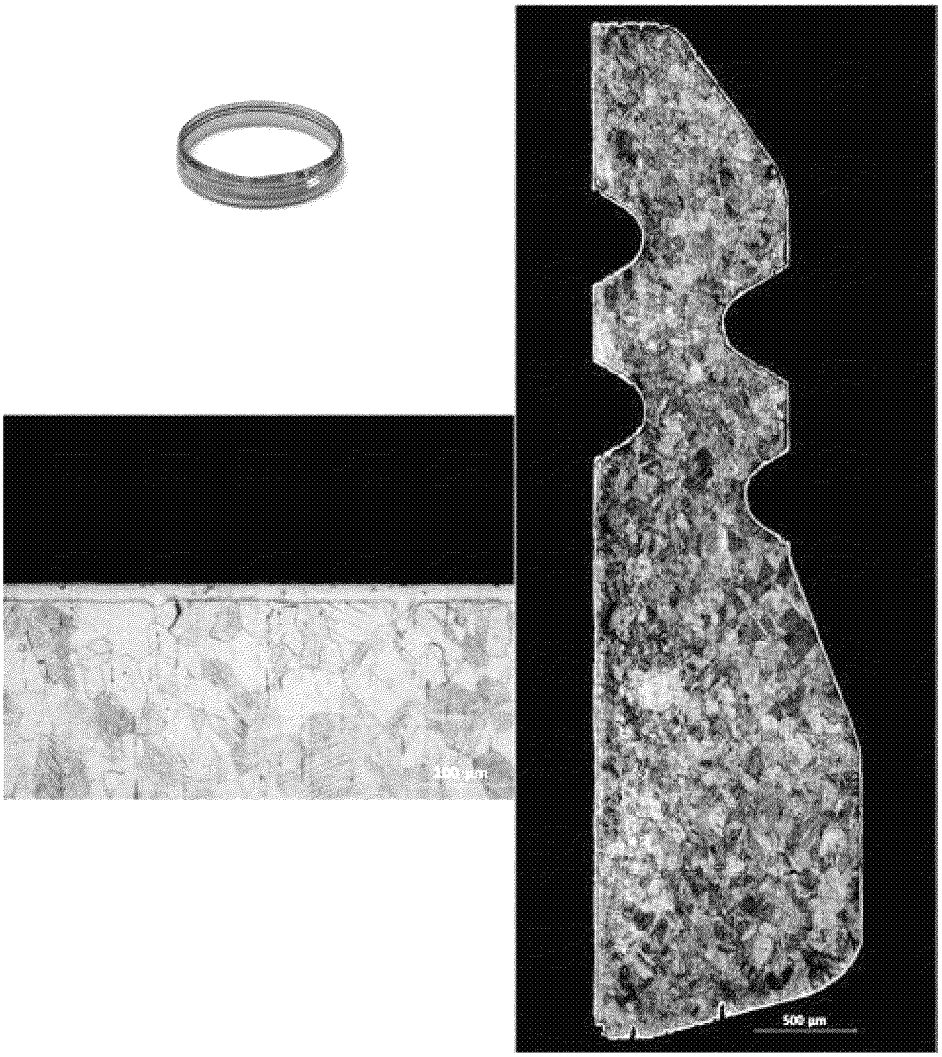
FIGS. 12 to 17 are diagrams showing results of carburization processing while varying a pressure range.
Figure 13:
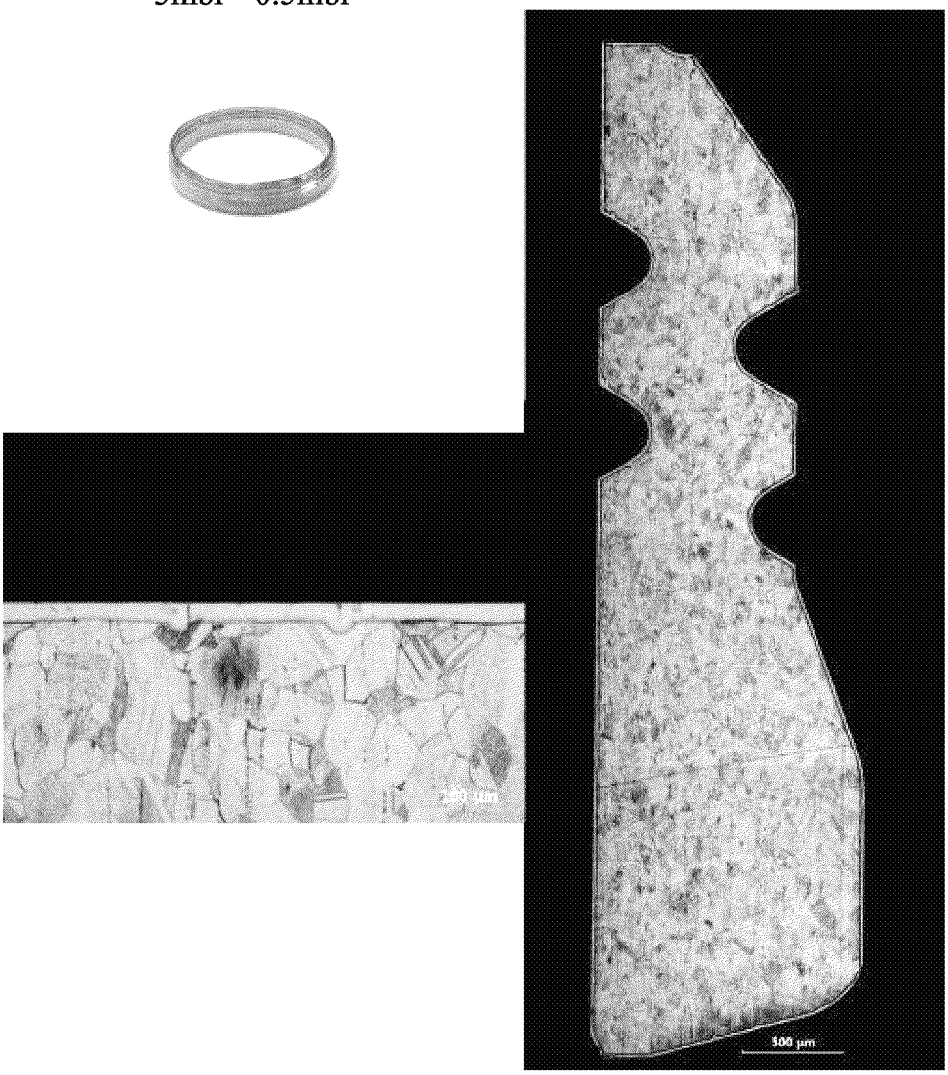

FIGS. 12 to 17 are diagrams showing results of carburization processing while varying a pressure range;

In the case of FIG. 12, the carburizing processing has been performed by supplying the pressure of the reaction gas at 5 mbar in the carburizing acceleration step and the pressure of the reaction gas at 0.5 mbar in the carburization spread step. In the case of FIG. 13, the carburizing processing has been performed by supplying the pressure of the reaction gas at 3 mbar in the carburizing acceleration step and the pressure of the reaction gas at 0.5 mbar in the carburization spread step. At this time, as the process progresses to the latter stage of the process, the relative processing time of the carburization spread step may be gradually increased in comparison with the carburization acceleration step.

As shown, both FIG. 12 and FIG. 13 clearly show that the carburizing layer is uniformly formed. In particular, in FIG. 13, the color of the metal to be processed is bright silver and the uniform carburizing layer is clearly visible with the naked eye.

That is, when the pressure of the reaction gas in the carburization spread step is set to 0.5 mbar and the pressure of the reaction gas in the carburizing acceleration step is set between 3 mbar and 5 mbar, an ideal carburizing layer may be formed. In particular, as can be seen from the figure, when the pressure of the reaction gas in the carburizing acceleration step is 3 mbar, the quality of the carburizing layer may be most excellent.

Figure 14:
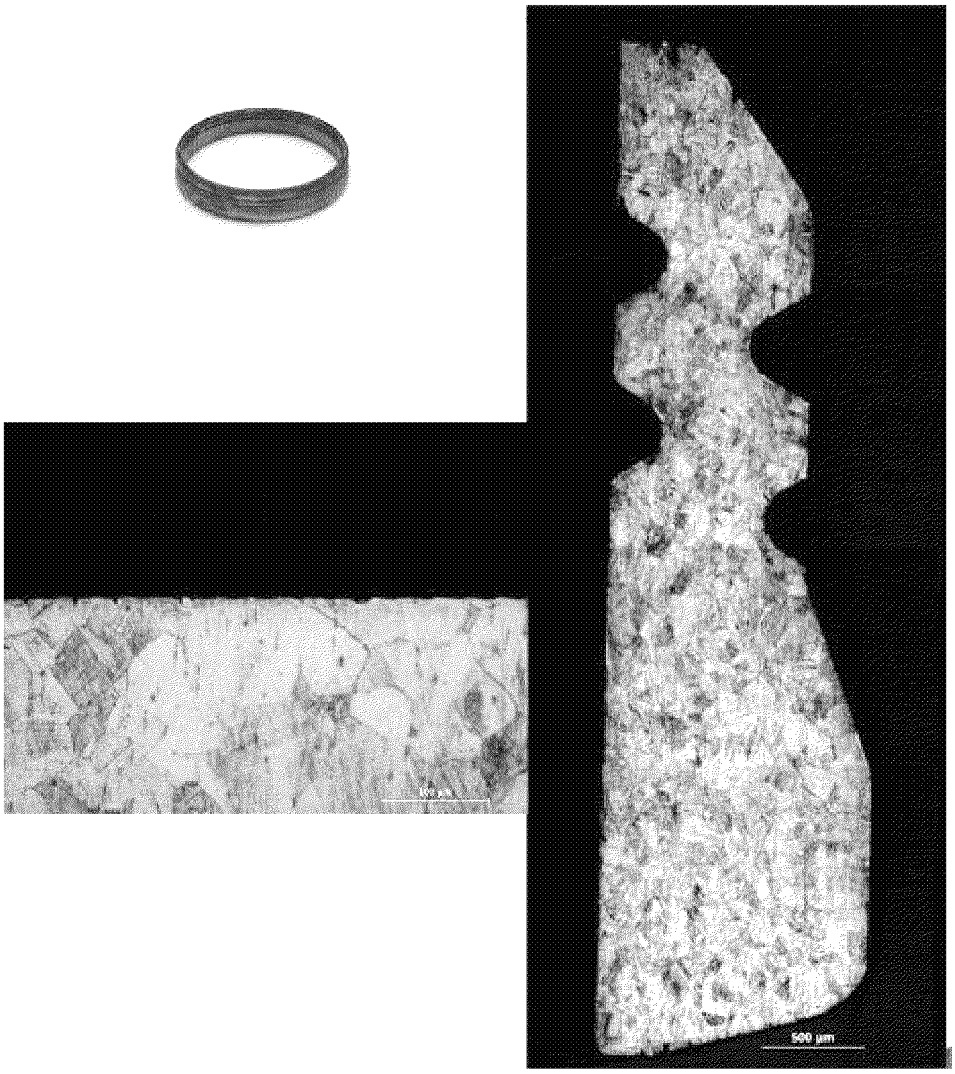
Figure 15:
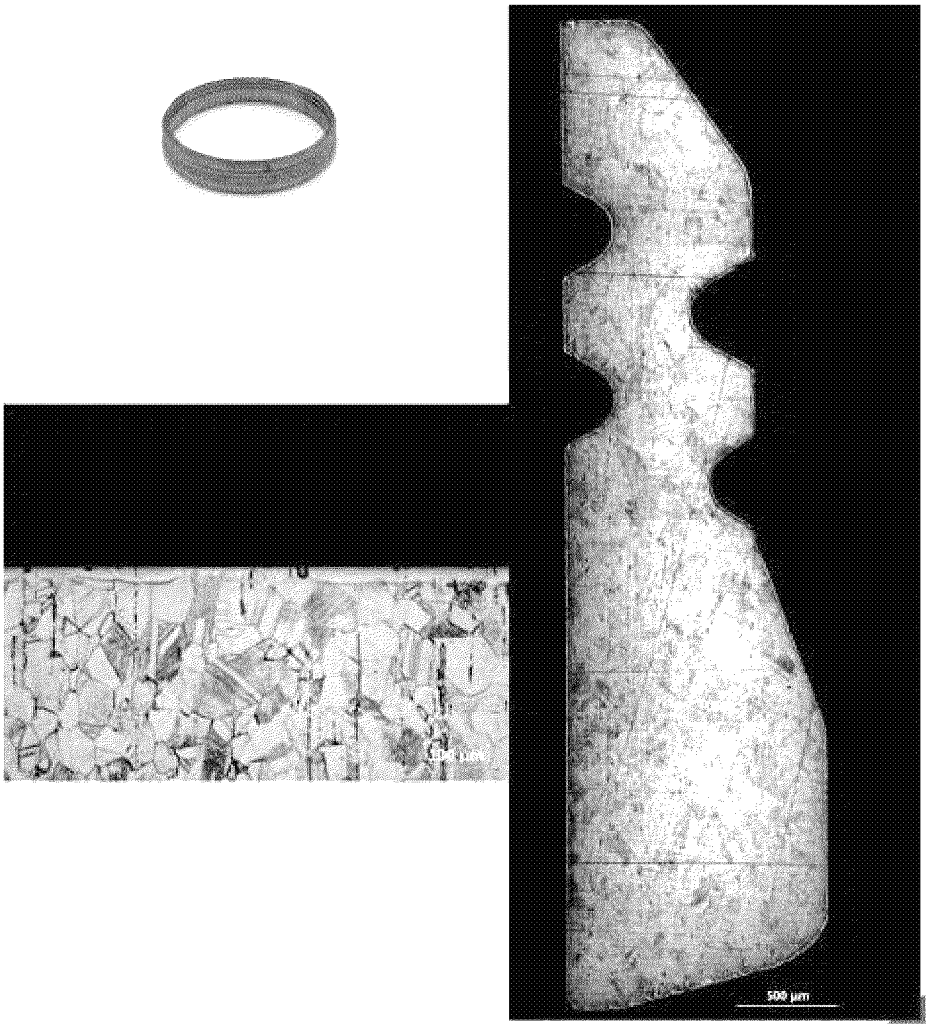

In the case of FIG. 14, the carburizing processing has been performed by supplying the pressure of the reaction gas at 5 mbar in the carburizing acceleration step and the pressure of the reaction gas at 0 mbar, that is, maintaining a vacuum state in the reaction chamber in the carburization spread step. In the case of FIG. 15, the carburizing processing has been performed by supplying the pressure of the reaction gas at 3 mbar in the carburizing acceleration step and the pressure of the reaction gas at 0 mbar in the carburization spread step. At this time, as the process progresses to the latter stage of the process, the relative processing time of the carburization spread step may be gradually increased in comparison with the carburization acceleration step.

As shown, in the case of FIG. 14, it is difficult to visually check the carburizing layer, and in the case of FIG. 15, the carburizing layer may be weakly formed, but the thickness of the carburizing layer is thin and the result is non-uniform over the entire circumference of the metal to be processed.

That is, when the supply of the reaction gas is completely stopped in the carburization spread step, the carburizing effect may be significantly reduced.

Figure 16:
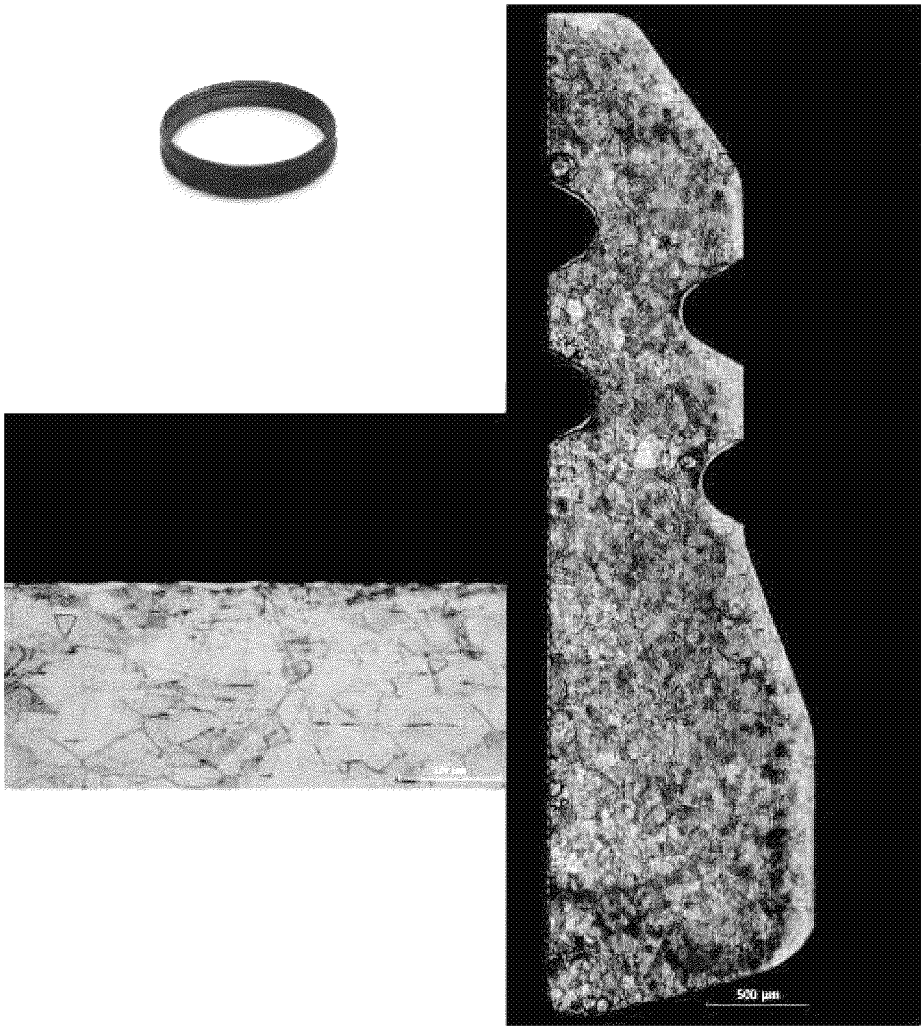
Figure 17:
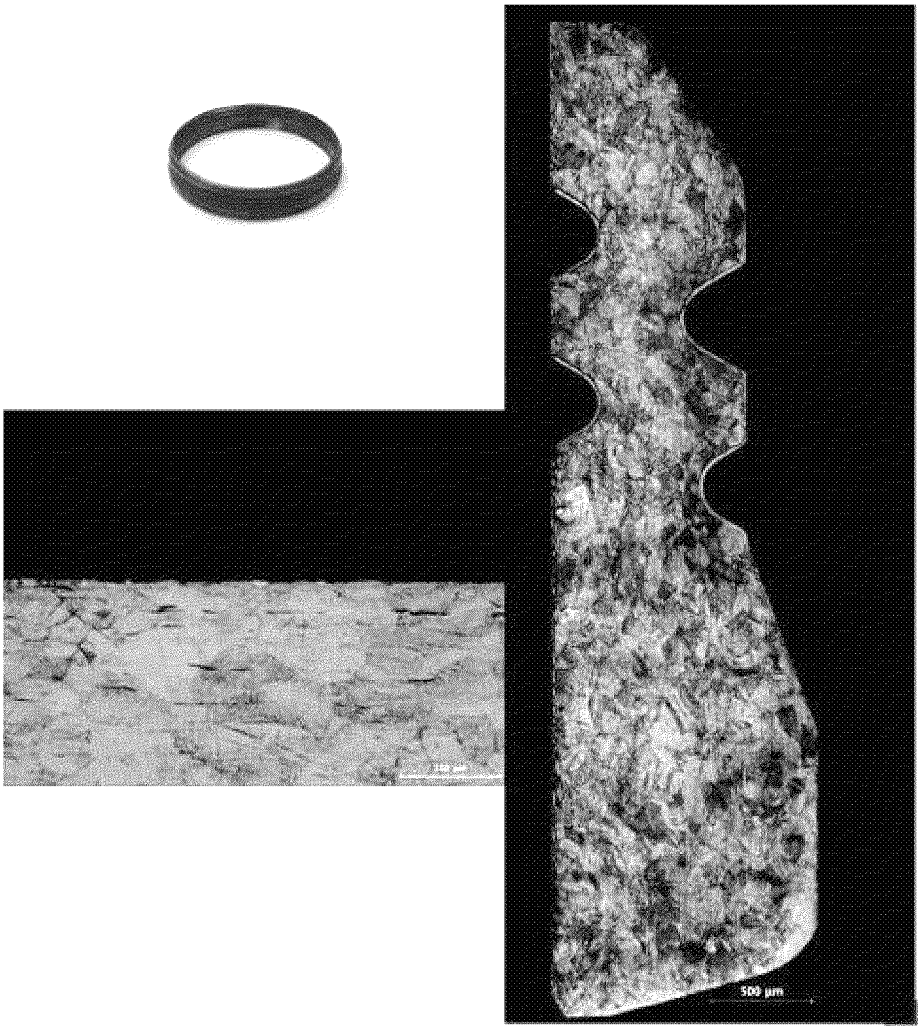

In the case of FIG. 16, the carburizing processing has been performed by uniformly supplying the pressure of the reaction gas at 3 mbar without distinguishing between the carburization acceleration step and the carburization spread step. In the case of FIG. 17, the carburizing processing has been performed by supplying the pressure of the reaction gas at 3 mbar in the carburization acceleration step and the pressure of the reaction gas at 0.5 mbar in the carburization spread step, and the processing time of the carburization spread step and the carburization acceleration step are maintained at the same intervals till the latter stage of the process.

As shown, in both FIG. 16 and FIG. 17, it can be seen that it is difficult to visually check the carburizing layer, and non-uniform result may be obtained over the entire circumference of the metal to be processed.

That is, when the reaction gas is supplied at a constant pressure without repeating the carburization spread step and the carburization acceleration step, or when the processing time of the carburization spread step and the carburization acceleration step is maintained at the same interval until the latter stage of the process, it also can be seen that the carburizing effect is significantly reduced.

The carburizing method according to the present invention is described above, and the carburizing apparatus of the present invention is described below.

The carburizing apparatus having a gas flow space according to the present invention may include a surface processing frame which form a plurality of layers in such a manner that at least some areas are spaced apart from each other to form a gas flow space where a metal member to be processed for performing a carburization processing is placed.

At this time, various transition metals may be applied as the material of the surface processing frame, and the surface processing frame may include a plurality of through holes through which reaction gas for carburizing flows into the gas flow space.

Accordingly, when the reaction gas is supplied into the chamber after the metal member to be processed is charged into the chamber while the metal member to be processed is accommodated in the gas flow space formed inside the surface processing frame, the reaction gas may flow into the gas flow space through the through hole, and then the reaction gas may flow along the surface of the metal member to be processed.

In addition, the surface processing frame may have various embodiments. Hereinafter, various embodiments of the surface processing frame and corresponding results of carburizing processing are described.

Figure 18:
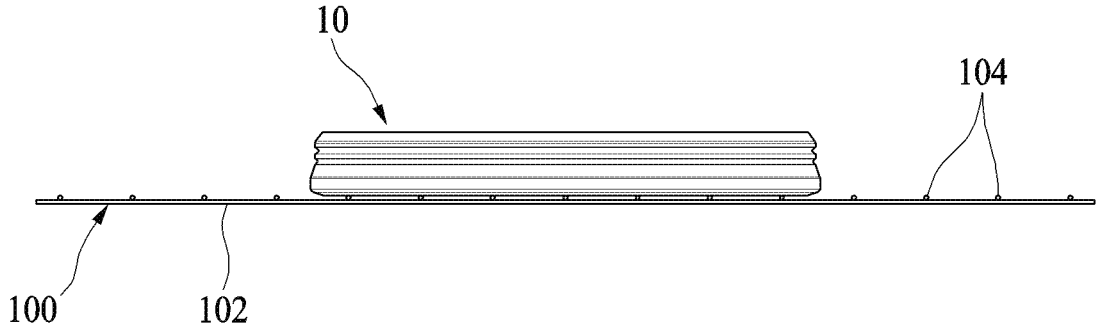
FIG. 18 and FIG. 19 are diagrams showing a carburizing apparatus according to the first embodiment of the present invention.
Figure 19:
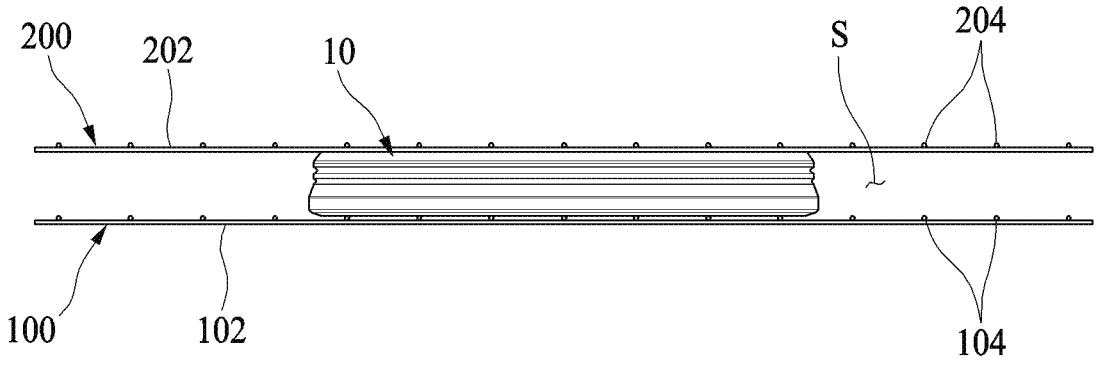

FIG. 18 and FIG. 19 are diagrams showing a carburizing apparatus according to the first embodiment of the present invention.

In the case of the first embodiment of the present invention shown in FIG. 18 and FIG. 19, the surface processing frame of the carburizing apparatus may be implemented in a form of a mesh to form a single layer. That is, in the present embodiment, an empty space formed between wefts 102, 202 and warps 104, 204 may form a through hole.

Accordingly, as shown in FIG. 18, a first layer 100 may be formed by laying a mesh on the bottom, and then the metal member 10 to be processed may be placed on the first layer 100, and another mesh may be placed on the upper portion of the metal member 10 to be processed to form a second layer 200.

Figure 20:
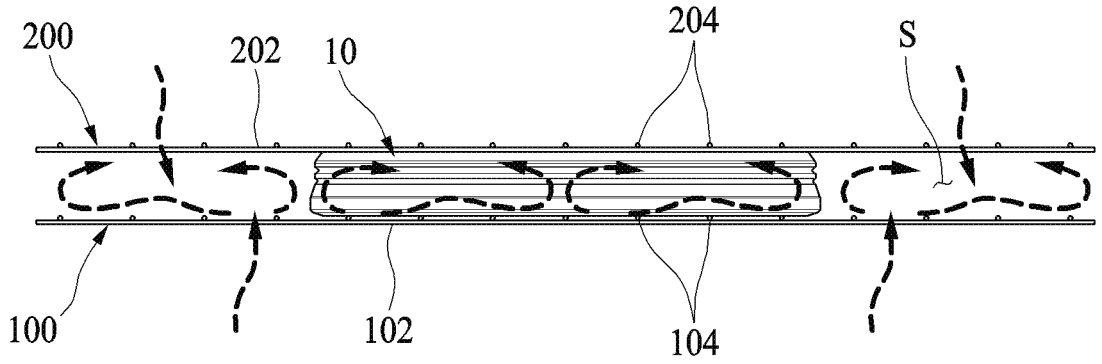
FIG. 20 is a diagram showing a carburizing process performed through the carburizing apparatus according to the first embodiment of the present invention.

Therefore, the first layer 100 and the second layer 200 may be spaced apart from each other so that a gas flow space S where the metal member 10 to be processed is positioned is formed between the first layer 100 and the second layer 200 and, as shown in FIG. 20, the gas introduced through the through hole between the mesh may remain in the gas flow space S and flow along the surface of the metal member 10 to be processed.

Further, the surface processing frame according to the present embodiment may form two or more layers.

Figure 21:
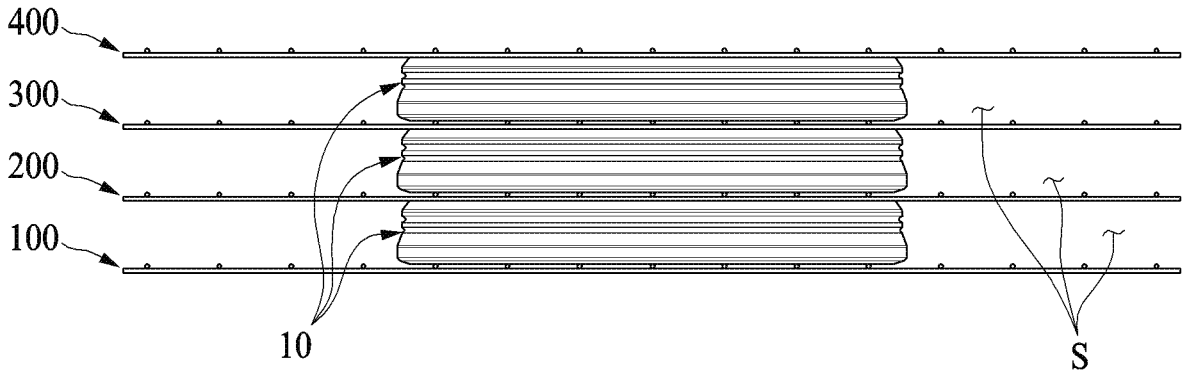
FIG. 21 is a diagram showing a multi-layered structure of the carburizing apparatus according to the first embodiment of the present invention.

That is, as shown in FIG. 21, the layers 100, 200, 300, and 400 formed of a plurality of meshes may be stacked to be multilayer, and the carburization processing may be performed in a state where the metal member 10 to be processed is placed in the gas flow space S formed between the layers.

At this time, it is obvious that that a plurality of the metal members 10 to be processed may be accommodated in a single gas flow space S.

Figure 22:
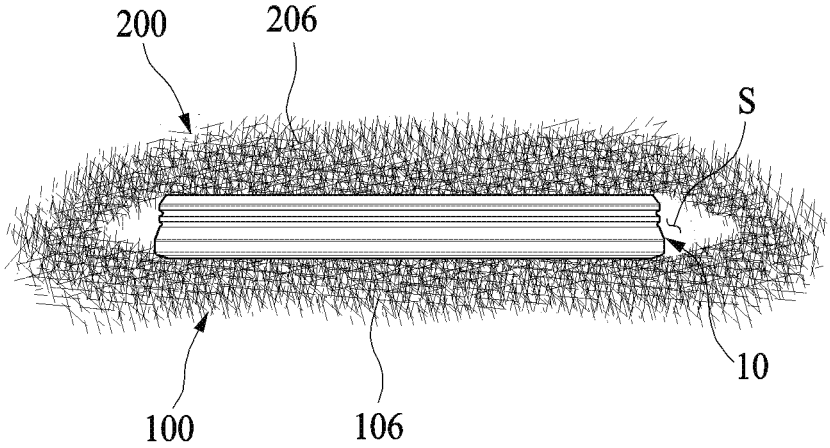
FIG. 22 is a diagram showing a carburizing apparatus according to the second embodiment of the present invention.

FIG. 22 is a diagram showing a carburizing apparatus according to the second embodiment of the present invention.

In the case of the second embodiment of the present invention shown in FIG. 22, the surface processing frames of the carburizing apparatus may be implemented in the form of steel wool 106, 206, assembled with each other, to form a single layer. That is, in the present embodiment, an empty space formed between the assembled unit steel wools 106, 206 may form a through hole.

In this case, first, a plurality of steel wools 106 may be laid on the bottom to form a first layer 100, then the metal member 10 to be processed may be placed, and another steel wool 206 may be placed on the top to form a second layer 200.

Accordingly, the first layer 100 and the second layer 200 may be spaced apart from each other to form a gas flow space S where the metal member 10 to be processed is positioned, and the gas introduced through the through hole between the steel wools may remain in the gas flow space S and flow along the surface of the metal member 10 to be processed.

In the present embodiment, similarly to the above-described first embodiment, two or more layers may be formed, and a plurality of the metal members 10 to be processed may be accommodated in a single gas flow space S.

Figure 23:
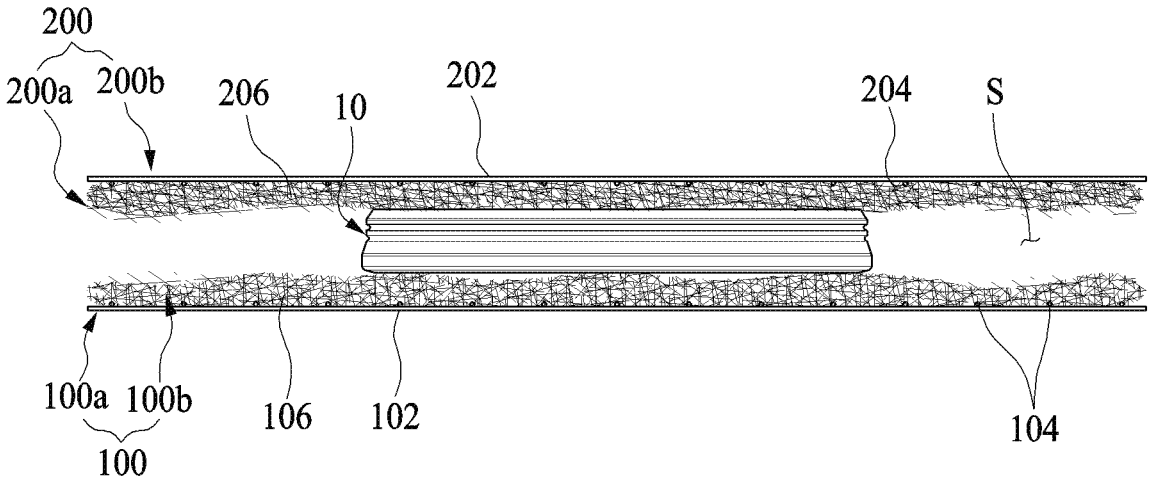
FIG. 23 is a diagram showing a carburizing apparatus according to a third embodiment of the present invention.

FIG. 23 is a diagram showing a carburizing apparatus according to a third embodiment of the present invention.

In the case of the third embodiment of the present invention shown in FIG. 23, the surface processing frame of the carburizing apparatus may form a single layer in a form in which the mesh and the steel wools 106, 206, assembled with each other, are all overlapped. That is, in the present embodiment, the empty space formed between the wefts 102, 202 and warps 104, 204 of the mesh, and the empty space formed between the assembled unit steel wools 106, 206 may form a through hole.

In this case, after the first layer 100 having a lower structure 100*a* and an upper structure 100*b* is formed by laying a mesh on the bottom and laying a plurality of steel wools 106 on the upper portion of the mesh, the metal member 10 to be processed may be placed and then another mesh and steel wool 206 may be placed on the top to form a second layer 200 having a lower structure 200*a* and an upper structure 200*b*.

Accordingly, the first layer 100 and the second layer 200 may be spaced apart from each other to form a gas flow space S where the metal member 10 to be processed is positioned, and the gas introduced through the through hole between the mesh and the steel wool may remain in the gas flow space S and flow along the surface of the metal member 10 to be processed.

At this time, the through hole formed between the assembled steel wool may be smaller than the through hole formed in the mesh.

In addition, in the present embodiment, similarly to the above-described first embodiment and the second embodiment, two or more layers may be formed, and a plurality of the metal members 10 to be processed may be accommodated in a single gas flow space S.

In addition, it is obvious that the shape of each layer of the first to third embodiments may be used interchangeably.

Hereinafter, a practical application of the carburizing apparatus according to the present invention and a result of corresponding carburizing processing are described. Since the low temperature carburizing method described above can be applied to this carburizing process, a detailed description of the processing method is omitted.

Figure 24:
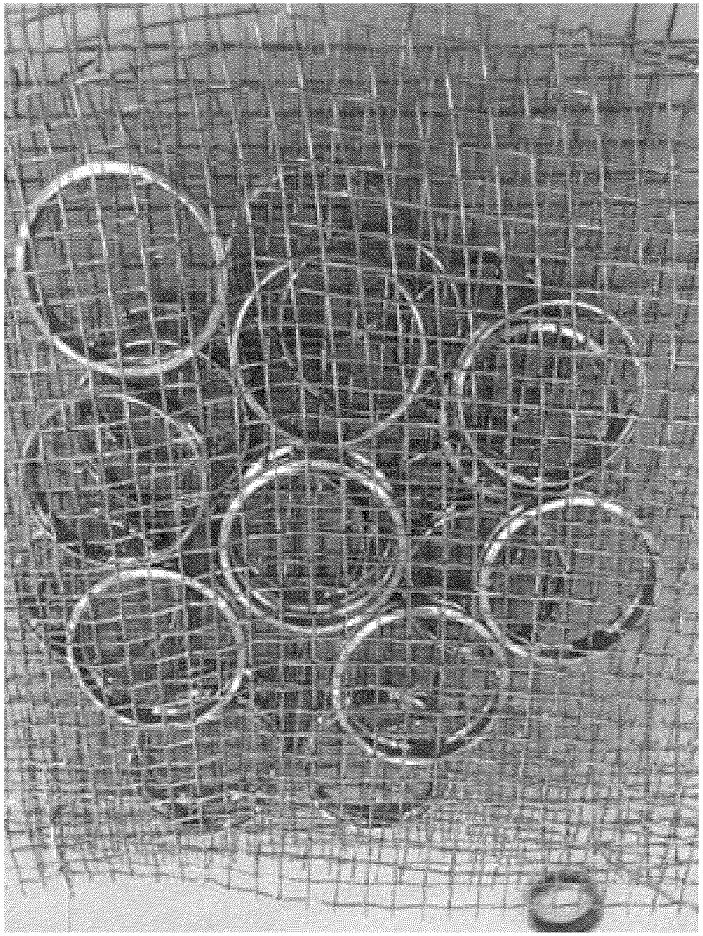
FIG. 24 is a photograph showing a state in which the carburizing apparatus according to the first embodiment of the present invention is actually applied.

FIG. 24 is a photograph showing a state in which the carburizing apparatus according to the first embodiment of the present invention is actually applied, and FIG. 8 is a photograph showing an appearance of a metal member which performed a carburizing processing through the carburizing apparatus according to the first embodiment of the present invention.

Referring to FIG. 24, as described above, it can be actually checked that the mesh-type surface processing frame of the first embodiment is applied.

Figure 25:
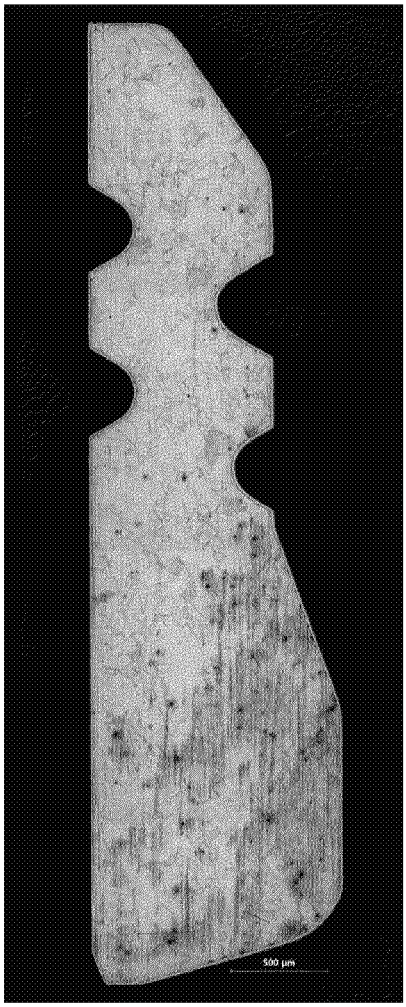
FIG. 25 is a photograph showing a state of a metal member to be processed which accomplished a carburizing processing through the carburizing apparatus according to the first embodiment of the present invention.

As a result of performing the carburizing processing through this, as shown in FIG. 25, it can be checked that carbon aggregates of externals is rarely seen, and, in addition, it can be checked that the carburizing layer is very uniformly formed with only a slight deviation.

Figure 26:
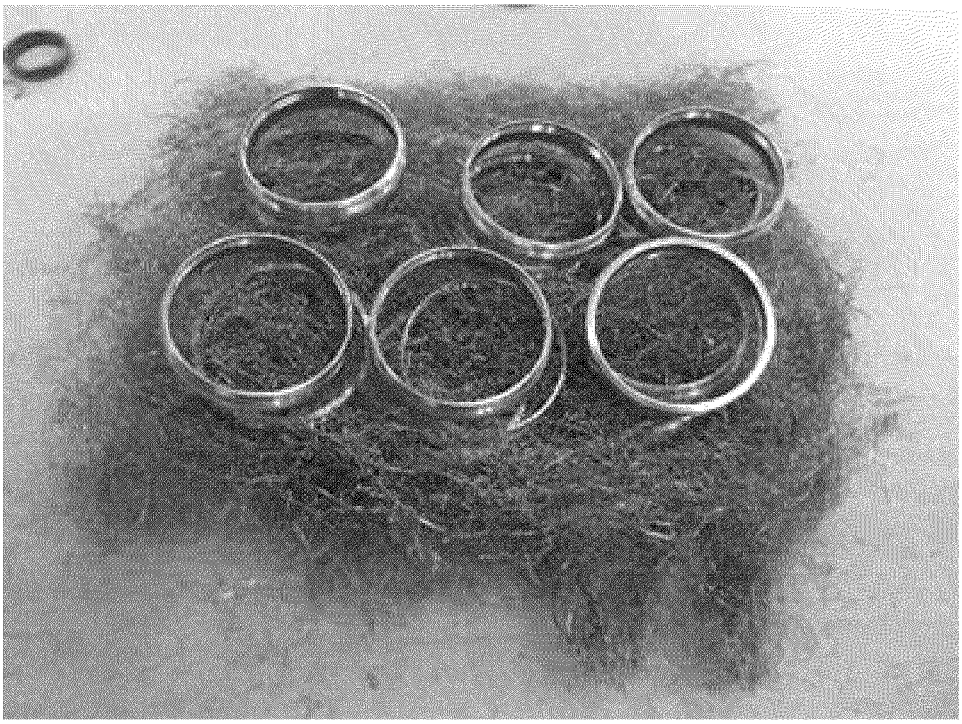
FIG. 26 is a photograph showing a state in which the carburizing apparatus according to the second embodiment of the present invention is actually applied.
Figure 27:
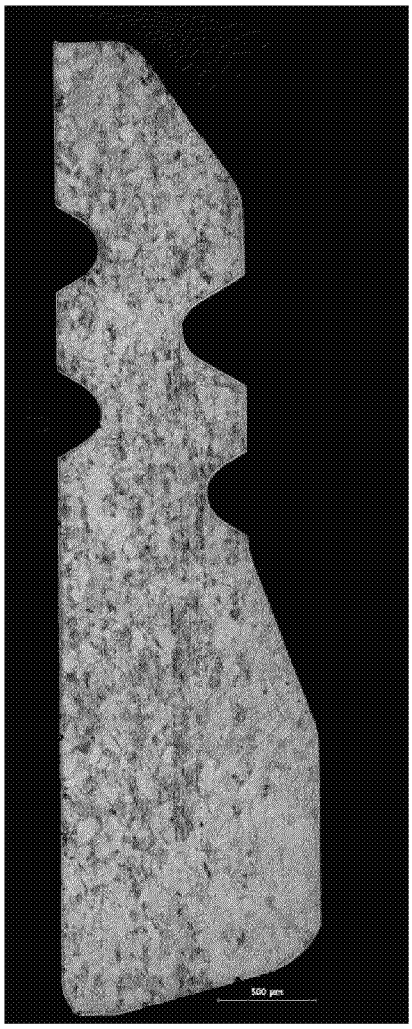
FIG. 27 is a photograph showing a state of a metal member to be processed which accomplished a carburizing processing through the carburizing apparatus according to the second embodiment of the present invention.

FIG. 26 is a photograph showing a state in which the carburizing apparatus according to the second embodiment of the present invention is actually applied, and FIG. 27 is a photograph showing a state of a metal member to be processed which accomplished a carburizing processing through the carburizing apparatus according to the second embodiment of the present invention;

FIG. 26 is a photograph showing a practical application of the carburizing apparatus according to the second embodiment of the present invention, and FIG. 27 is a view showing a state in which the carburizing apparatus according to the second embodiment of the present invention It is the photograph which showed the appearance.

Referring to FIG. 26, as described above, it can be actually checked that the steel-wool-typed surface processing frame of the second embodiment is applied.

As a result of performing the carburizing processing through this, as shown in FIG. 27, it can be checked that carbon aggregates of externals is rarely seen, and, in addition, it can be checked that the carburizing layer is very uniformly formed with only a slight deviation.

Figure 28:
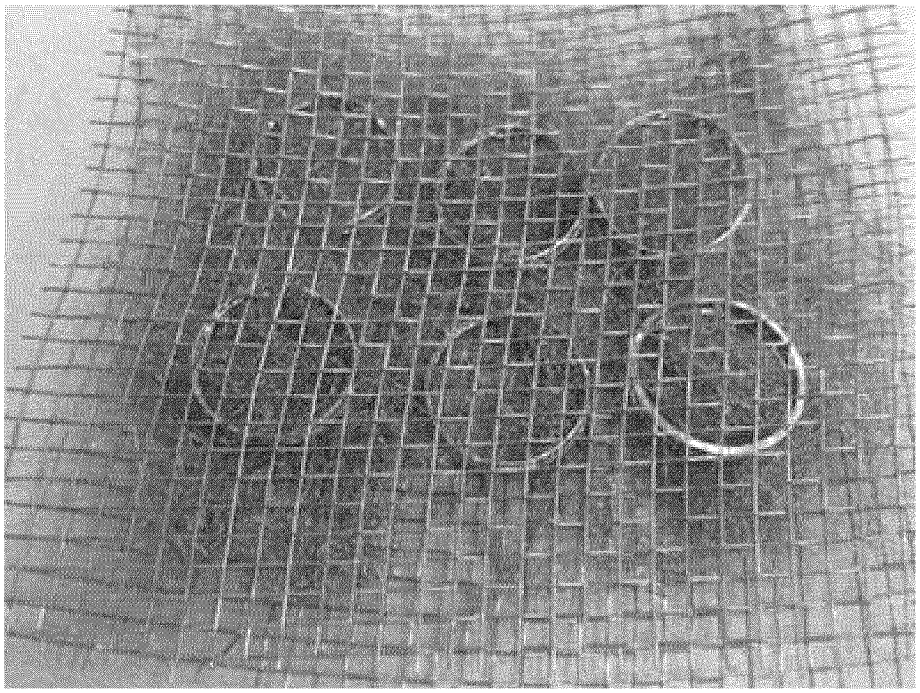
FIG. 28 is a photograph showing a state in which the carburizing apparatus according to the third embodiment of the present invention is actually applied.
Figure 29:
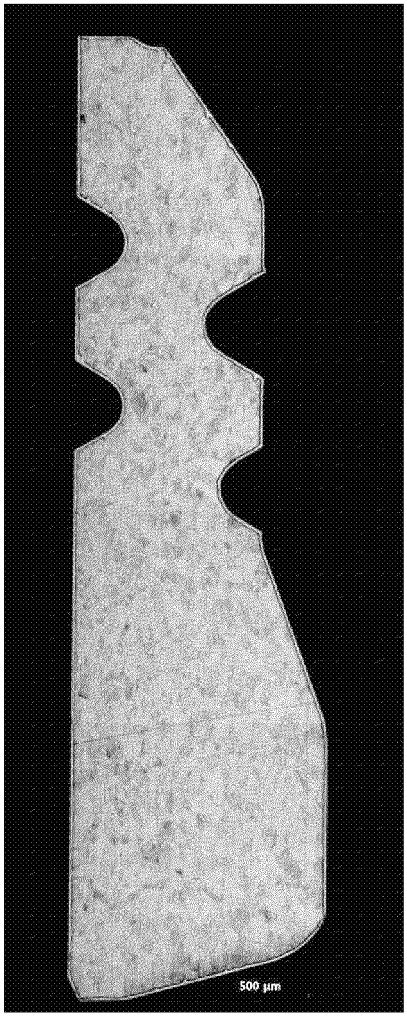
FIG. 29 is a photograph showing a state of a metal member to be processed which accomplished a carburizing processing through the carburizing apparatus according to the third embodiment of the present invention.

FIG. 28 is a photograph showing a state in which the carburizing apparatus according to the third embodiment of the present invention is actually applied, and FIG. 29 is a photograph showing a state of a metal member to be processed which accomplished a carburizing processing through the carburizing apparatus according to the third embodiment of the present invention.

Referring to FIG. 28, as described above, it can be checked that the surface processing frame in the form of a combination of the mesh and the steel wool of the third embodiment is applied.

As a result of performing the carburizing processing through this, as shown in FIG. 29, it can be checked that carbon aggregates of externals is not generated at all and is silverish, and, in addition, it can be checked that the carburizing layer is uniformly formed all around.

As described above, the present invention can be varied depending on the shape of the metal member to be processed, and the gas flow behavior of the heat processing equipment, thereby not having a prescribed shape.

Further, the present invention can more uniformly distribute the process gas on the surface of the metal member to be processed and further activate the process gas through the transition metal such as mesh or steel wool to uniformly perform the surface processing for the metal member having a complicated shape or a small size.

Although the exemplary embodiments of the present invention have been disclosed for illustrative purposes, those skilled in the art will appreciate that various modifications, additions and substitutions are possible, without departing from the scope and spirit of the invention as disclosed in the accompanying claims. Accordingly, the scope of the present invention is not construed as being limited to the described embodiments but is defined by the appended claims as well as equivalents thereto.

The invention claimed is:

1. A carburizing method comprising:

step (a) for pre-processing a metal to be processed;

step (b) for inputting the metal to be processed to a reaction chamber and heating the same to a set temperature;

step (c) for forming a vacuum atmosphere in the reaction chamber and introducing a reaction gas thereinto at a predetermined pressure to accelerate carburization;

step (d) for supplying the reaction gas to the reaction chamber at a pressure equal to or lower than the pressure of the reaction gas of step (c) to spread carburization; and step (e) for repeating step (c) and step (d) at predetermined time intervals, wherein the step (c) comprises supplying the reaction gas to reaction chamber at a pressure equal to or less than 5 mbar to accelerate carburization, wherein the step (d) comprises supplying the reaction gas to the reaction chamber at a pressure equal to or more 0.5 mbar and equal to or less than the pressure of the reaction gas of the step (c) and spreading the carburization.

2. The method of claim 1, wherein the step (a) comprises removing or weakening a natural oxide film by performing a pickling process for the metal to be processed.

3. The method of claim 1, wherein the step (b) comprises:

step (b-1) for forming a vacuum atmosphere in the reaction chamber;

step (b-2) for heating an inside of the reaction chamber to a target temperature, and weakening an internal stress of the metal to be processed; and step (b-3) for injecting a processing gas into the reaction chamber and processing a surface of the metal to be processed, and weakening a bonding strength between a natural oxide film and the metal to be processed.

4. The method of claim 3, wherein the step (b-2) comprises changing the target temperature according to a target hardness of the metal to be processed, wherein the step (b-3) comprises changing a composition of the processing gas according to the target temperature of the step (b-2).

5. The method of claim 1, wherein, in the step (c), the reaction gas is a mixed gas of 20 to 70% hydrogen gas and 30 to 80% acetylene gas.

6. The method of claim 1, wherein the step (c) comprises supplying the reaction gas at a pressure of 3 mbar, wherein the step (d) comprises supplying the reaction gas at a pressure of 0.5 mbar.

7. The method of claim 1, wherein the step (c) comprises supplying the reaction gas at a pressure of 5 mbar, wherein the step (d) comprises supplying the reaction gas at a pressure of 0.5 mbar.

8. The method of claim 1, wherein the step (d) comprises stopping an injection of the reaction gas, and forming a vacuum atmosphere in the reaction chamber.

9. The method of claim 1, wherein the step (e) comprises gradually reducing a total process time of the step (c) which is repeated.

10. The method of claim 1, wherein the step (e) comprises gradually increasing a total process time of the step (d) which is repeated.

* * * * *